United States Patent [19]

Hukumoto et al.

[11] 4,147,819

[45] Apr. 3, 1979

[54] METHOD FOR FORMING POLYPHENYLENE SULFIDE RESIN COATING ON THE SURFACE OF METAL SUBSTRATE

[75] Inventors: Yorio Hukumoto, Kowachi Nagano; Hiroshi Kashiwadani; Shuji Hiramatsu, both of Ohtsu, all of Japan

[73] Assignee: Sekisui Kagaku Kogyo Kabushiki Kaisha

[21] Appl. No.: 778,325

[22] Filed: Mar. 16, 1977

[30] Foreign Application Priority Data

Mar. 19, 1976 [JP] Japan ..... 51-30354

[51] Int. Cl.[2] ..... B05D 3/02

[52] U.S. Cl. ..... 427/195; 427/374 B; 427/374 C; 427/374 D; 427/375; 427/379; 427/388 A; 427/388 R; 427/398 B

[58] Field of Search ..... 427/195, 398 B, 379, 427/388 R, 388 A, 375, 374 B, 374 C, 374 D; 260/79

[56] References Cited

U.S. PATENT DOCUMENTS

| | | | |
|---|---|---|---|
| 2,952,561 | 9/1960 | Young et al. | 427/398 B |
| 3,294,573 | 12/1966 | Michael et al. | 427/398 B |
| 3,354,129 | 11/1967 | Edmonds et al. | 260/79 |
| 3,411,933 | 11/1968 | Moore | 427/195 |
| 3,801,379 | 4/1974 | Blackwell | 427/195 |
| 3,869,300 | 3/1975 | Scheiber | 427/195 |
| 4,009,301 | 2/1977 | Heckman et al. | 427/195 |
| 4,012,539 | 3/1977 | Davies | 427/195 |

OTHER PUBLICATIONS

"Polyolefins: Structure and Properties", Boenig, Elsevier Publishing Co., 1966, pp. 212–217 and 136–139.

*Primary Examiner*—Michael F. Esposito
*Assistant Examiner*—Janyce A. Bell
*Attorney, Agent, or Firm*—Wenderoth, Lind & Ponack

[57] ABSTRACT

An improved method for forming a coating of a polyphenylene sulfide on the surface of a metal substrate which comprises fusing a powder of polyphenylene sulfide to the surface of substrate metal and then curing the resin under heat; wherein the fused polyphenylene sulfide resin is solidified by quenching, and then heat-cured. This method permits increased operational efficiency and productivity over the prior technique.

4 Claims, No Drawings

METHOD FOR FORMING POLYPHENYLENE SULFIDE RESIN COATING ON THE SURFACE OF METAL SUBSTRATE

This invention relates to a method for forming a coating of a polyphenylene sulfide resin, and more specifically, to a method for powder coating of a polyphenylene sulfide on the surface of a metal substrate.

Polyphenylene sulfide resins, because of their high heat resistance, excellent chemical resistance, and nonburning and nondripping beahvior, find a wide range of applications, for example, for surface coating of various kinds of metallic material such as the external coating of various machine parts (e.g., valves, stirring blades, or pump impellers) or the internal coating of pipes or pipe fittings, and for surface coating of cookware such as frying pans or baking pans.

When the powder coating of a polyphenylene sulfide resin (to be sometimes abbreviated as a PPS resin) on the surface of a metal substrate is performed merely by adhering the PPs resin powder to the metal substrate surface, and fusing it to the metal surface to form a coating, the resin tends to crystallize rendering the coating brittle, or to develop other undesirable phenomena such as cracking or peeling of coating, as the coating is allowed to cool. In order to prevent the accurrence of such phenomena, it has been the previous practice to employ a method in which the PPs resin powder fused to the metal surface is subsequently aged at elevated temperatures for a long period of time so as to cure the resin coating (i.e., crosslinking and/or chain-extension).

The conventional technique can indeed serve to prevent the crystallization, cracking and peeling of the PPS resin coating. However, since according to this method, the time-consuming curing step must be carried out in succession to the step of fusing the PPS resin powder to the substrate metal surface which can be performed within a relatively short period of time, the method is low both in operating efficiency and productivity, and will result in an increase in the cost of production.

The present inventors made investigations in order to increase the operating efficiency and productivity by performing the fusing step and the curing step as separate independent steps. These investigations led to the discovery that the curing step can be separated from the fusing step if between these steps, the fused PPS resin is solidified by quenching.

It is an object of this invention therefore to peovide a method for powder-coating a polyphenylene sulfide resin on the surface of metal substrate with high operating efficiency and high productivity.

Another object of this invention is to provide a method for forming a tough and crack- and peel-free coating of a polyphenylene sulfide resin on the surface of a metal substrate by a powder coating process.

Other objects and advantages of the invention will become apparent from the following description.

According to the present invention, there is provided an improved method for forming a coating of a polyphenylene sulfide on the surface of a metal substrate which comprises fusing a powder of polyphenylene sulfide to the surface of substrate metal and then curing the resin under heat; wherein the fused polyphenylene sulfide resin is solidified by quenching, and then heat-cured.

According to the method of this invention, the PPS resin powder is first fused to the surface of a metal substrate.

The PPS resin that can be used in the present invention is a polymer of the type produced by a method disclosed, for example, in U.S. Pat. No. 3,354,129, and generally includes polymers having a recurring unit of the formula

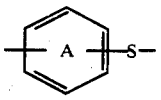

wherein ring A may have a substituent.

PPS resins conveniently used in the present invention are polymers having a recurring unit of the following formula

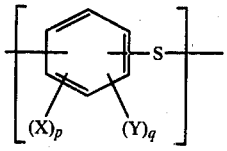

wherein each X is a halogen atom selected from the group consisting of chlorine, bromine, iodine and fluorine, preferably chlorine and bromine; and each Y is selected from the group consisting of hydrogen, —R, —N(R)$_2$, $$-\overset{O}{\overset{\|}{C}}-OR,\ -\overset{O}{\overset{\|}{C}}-OM,\ -\overset{O}{\overset{\|}{C}}-N(R)_2,\ -\overset{R}{\overset{|}{N}}-\overset{O}{\overset{\|}{C}}-R',$$

—O—R′, —S—R′, —SO$_3$H and —SO$_3$M in which each —R is selected from the group consisting of hydrogen and alkyl, cycloalkyl, aryl, aralkyl and alkaryl radicals containing from 1 to 12 carbon atoms, inclusive, each R′ is selected from the group consisting of alkyl, cycloalkyl, aryl, aralkyl and alkaryl radicals containing from 1 to 12 carbon atoms, inclusive, M is an alkali metal selected from the group consisting of sodium, potassium, lithium, rubidium and cesium, p is a number of 0 to 4, and q is a number of 2 to 4.

A polymer having a recurring unit of the formula

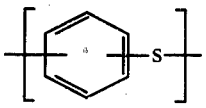

is especially preferred.

These polymers may be partially oxidized, or may optionally have a branched or crosslinked structure.

These PPS resins preferably have a melting point of about 280 to about 300° C. under normal conditions, and an intrinsic viscosity, in chloronaphthalene at 260° C., of at least 0.1, especially 0.1 to 0.3, most preferably 0.13 to 0.23.

The PPS resins are used in the form of powder. Their particle sizes are not critical, but those having a particle size of 10 to 200 microns are generally suitable.

The PPS resin powders can be used alone. Or if desired, as is conventional in the art, silica or titanium oxide powders may be added to it in order to improve coatability, for example. Or various additives may be added to provide formulations suitable for slurry coating, cold or hot electrostatic spraying, fluidized bed coating, powder spraying (flocking), dipping, etc.

Various metals such as steel, cast iron, stainless steel, copper or aluminum can be used as metal substrates to which the PPS resin powder is to be applied. Such metal substrates can be subjected to surface preparation in a customary manner. For example, prior to the application of PPS resin, the metal surfaces may be subjected in a manner known per se to baking at elevated temperatures, chemical treatment, grit blasting with a 60 to 120 grit medium. vapor degreasing, solvent washing, sonic degreasing, or thermal degradation.

When steel, cast iron or staniless steel is used as a substrate, a primer coating may be applied to the metal surface as needed in order to prevent oxidation and/or to promote adhesion (especially in the case of internal coating).

The PPS resin powder described hereinabove is fused to the surface of metal substrate so prepared. Fusing can be performed, for example, by slurry coating, hot or cold eletrostatic spraying, fluidized bed coating, or powder spraying (flocking). By heating the surface of substrate metal to a temperature above the melting point of the PPS resin before, during or after such coating or spraying, the PPS resin can be fused and bonded to the metal surface. For example, the PPS resin powder is adhered to the surface of metal by an electrostatic coating method, and then heat-melted; or the surface of metal is pre-heated, and the PPS resin powder is adhered to the surface by sparying, or dipping, etc. to allow it to fuse.

The heating temperature at the time of melting-adhering varies according, for example, to the type of the PPS resin, or the thickness of the coating. Generally, the heating temperature is above the melting point of the PPS resin, especially at least 300° C., preferably 340 to 380° C. Suitably, the above temperature is maintained for at least 3 seconds, usually 5 seconds to 10 minutes to perform melt-adhesion.

The greatest characteristic of pf the method of this invention is that the PPS resin powder which has been so fused to the metal substrate is, prior to the curing step, solidified by quenching. This enables the step of fusing the PPS resin powder to the surface of substrate metal to be separate and independent from the step of curing the fused PPS resin, and markedly increases the operating efficiency and productivity as compared with the conventional method.

The quenching in accordance with the present invention can be achieved by cooling the fused resin to 110° C. or below within 10 seconds before its temperature falls down to below 250° C., preferably to below 280° C.

Quenching may be carried out by any cooling means which can achieve the abrupt decrease of the temperature as described above. For practical purposes, it is most advantageous to dip the fused resin in water held at below 100 C., usually below room temperature. But as needed, other cooling media may also be used. Thus, for example, by dipping the PPS resin fused to the surface of metal substrate in water at room temperature, the resin can be quenched to 50° C. or below within 10 seconds.

This quenching treatment can substantially inhibit the crystallization of the fused PPS resin, and also prevent the occurrance of cracking or peeling. Hence, the method of the present invention can obviate the necessity of performing the curing step in succession to the fusing step.

The metal substrate having a PPS resin coating so quenched can then be subjected to the curing step. The curing step can be performed by ordinary methods. The curing temperature and time can be varied over broad ranges according, for example, to the type of the PPS resin, and the thickness of the coating. Advantageously, the curing is performed at a temperature of generally at least 300° C., preferably 340 to 420° C., for a period of usually at least 60 minutes, preferably 90 minutes to 96 hours. Generally, the reaction time may be shorter when the reaction temperature is higher.

Thus, according to the method of this invention, the step of fusing PPS resin powder which can be completed within a relatively short period of time can be made separate and independent from the time-consuming curing step for the fused resin. Accordingly, it is not necessary to perform the fusing step and the curing step as a continuous process as in the conventional method, and the operating efficiency and productivity can be markedly increased.

Moreover, the coated products obtained by the method of this invention are beautiful and free from cracks and ensure a firm adhesion of the coatings.

Thus, according to the method of this invention, PPS coatings can be used successfully in many highly corrosive applications such as pipe coupling, elbows, pumps, valves, tanks, reactors, sucker rods, oil well tubing, fan drive discs, amd cookware, and many others.

The following Examples further illustrates the present invention.

EXAMPLE 1

A steel sheet, 1.6 mm thick, heated to 370° C. was dipped for 2 seconds in a tank filled with a powder of a polyphenylene sulfide resin with a particle size of 20 to 200 microns (RYTON PP-P-2, a trademark for a product of Phillips Petroleum Company), and withdrawn from the tank. After ascertaining that the surface of the steel sheet was uniformly covered with a black coating of the resin and before the temperature of the resin fell down to below 288° C., the coated steel sheet was dipped in a tank filled with water held at room temerature to quench it. Within several seconds, the temperature of the resin fell down to below 100° C., and the steel sheet was covered uniformly with a black coating having a thickness of about 200 microns, and the coating was free from cracks and peeling. The degree of crystallization of the resin covering the coated steel sheet was nearly zero. There was hardly any increase in the degree of crystallization and no change in the outer shape of the coated article was observed, even after allowing the coated article to stand for long periods of time.

However, when such a coated article is used in applications where it is heated to above 100° C. and then allowed to cool, the resin will crystallize, develop cracking, and be peeled off, and the coated article as obtained cannot be used in such applications.

Accordingly, the coated article was heated at 370° C. for 90 minutes and allowed to cool. A heat-treated coated article was thus obtained whose metallic surface was uniformly covered with a black, crack- and peel-free coating of the crosslinked resin and which did not change during use in the heated state nor with time.

When the coated resin was not quenched but allowed to cool, the coated article was covered with a brown resin coating having cracking and peeling (the resin had a degre of crystallization of 60%). Even by heat-treating this coated article at the same crosslinking temperature as mentioned above, the cracking and peeling of the coating could not be remedied.

EXAMPLE 2

A steel sheet having a thickness of 1.6 mm was heated to 350° C. and fully dipped for 2 seconds in a tank containing PPS resin powder having a particle size of 20 to 200 microns (RYTON PPS-P-2, a trademark for a product of Phillips Petroleum Company). It was withdrawn from the tank to fuse the PPS and to form a coating having a thickness of 200 to 250 microns.

the coated steel sheet was allowed to cool to each of the "temperatures before quenching" tabulated below, and quenched in accordance with the "quenching conditions" tabulated below. The quenched product was then cured at 370° C. for 90 minutes in a hot air-circulating type oven. The condition of the coating in each product is also shown in the following table.

The condition of the coating was evaluated on a scale of "good" which means that the coating is in good condition, "fair" which means that crack formation is little, and "poor" which means that crack formation is considerable.

| Temperature before quenching (° C.) | Quenching conditions | | Color of the resin before curing | Condition of the coating after curing |
|---|---|---|---|---|
| 300 | Dipped in water at 20° C. for the times indicated below, and allowed to cool to room temperature. | | | |
| | Dipping time (sec.) | Temperature of the resin immediately after withdrawal from water (° C.) | | |
| | 1 | 220 | Brown | Poor |
| | 2 | 166 | Dark brown | Fair |
| | 8 | 41 | Black | Good |
| | Dipped in water at 100° C. for 10 seconds, and allowed to cool to room temperature. (Immediately after withdrawal from water, the temperature of the resin was 102° C.) | | Black | Good |
| | Air cooling (spontaneous cooling) A period of 13 minutes was required until the temperature of the resin fell down to 100° C. | | Brown | Poor |
| 250 | Dipped in water at 20° C. for the times indicated below, and allowed to cool to room temperature. | | | |
| | Dipping time (sec.) | Temperature of the resin immediately after withdrawal from water (° C.) | | |
| | 1 | 190 | Brown | Poor |
| | 2 | 143 | Dark brown | Fair |
| | 8 | 38 | Black | Good |
| 200 | Dipped in water at 20° C. for the times indicated below, and allowed to cool to room temperature. | | | |
| | Dipping time (sec.) | Temperature of the resin immediately after withdrawal from water (° C.) | | |
| | 1 | 145 | Brown | Poor |
| | 2 | 113 | Dark brown | Fair |
| | 8 | 35 | Dark brown | Fair |
| 150 | Dipped in water at 20° C. for the times indicated below, and allowed to cool to room temperature. | | | |
| | Dipping time (sec.) | Temperature of the resin immediately after withdrawal from water (° C.) | | |
| | 2 | 87 | Brown | Poor |
| | 8 | 31 | Brown | Poor |

What we claim is:

1. In a method for forming a coating of a polyphenylene sulfide on the surface of a metal substrate which comprises fusing a powder of polyphenylene sulfide to the surface of metal substrate and then curing the resin under heat, the improvement which comprises quenching the fused polyphenylene sulfide resin to solidify it, and then heat-curing the resin.

2. The method of claim 1 wherein the polyphenylene sulfide resin fused at a temperature above its melting point is quenched to 110° C. or below within 10 seconds before its temperature falls down to below 250° C.

3. The method of claim 2 wherein the resin is quenched before its temperature falls down to below 280° C.

4. The method of claim 1 wherein the quenching is carried out by dipping the metal substrate having the polyphenylene sulfide resin fused thereto in water held at a temperature of 100° C. or below.

* * * * *

Notice of Adverse Decision in Interference

In Interference No. 100,310, involving Patent No. 4,147,819, Y. Hukumoto, H. Kashiwadani and S. Hiramatsu, METHOD FOR FORMING POLYPHENYLENE SULFIDE RESIN COATING ON THE SURFACE OF METAL SUBSTRATE, final judgment adverse to the patentees was rendered Mar. 27, 1981, as to claims 1-4.

[*Official Gazette June 2, 1981.*]